United States Patent [19]

Wegener

[11] 4,030,913

[45] June 21, 1977

[54] METHOD OF STABILIZING PYROPHOROUS IRON POWDER

[75] Inventor: Joachim Wegener, Aachen, Germany

[73] Assignee: U.S. Philips Corporation, New York, N.Y.

[22] Filed: May 26, 1976

[21] Appl. No.: 690,079

[30] Foreign Application Priority Data

June 3, 1975 Germany ..... 2524517

[52] U.S. Cl. ..... 75/.5 R; 21/2.5 R; 75/.5 AA; 75/.5 BA; 148/6.35

[51] Int. Cl.[2] ..... C23F 9/02; C23F 11/14

[58] Field of Search ..... 75/.5 R, .5 BA, .5 AA; 21/2.5 R; 148/6.35

[56] References Cited

UNITED STATES PATENTS

| | | | |
|---|---|---|---|
| 2,677,669 | 5/1954 | Ahlberg | 75/.5 R |
| 3,480,425 | 11/1969 | Hardy et al. | 75/.5 R |
| 3,617,394 | 11/1971 | Mayer | 148/6.35 |

*Primary Examiner*—W. Stallard

*Attorney, Agent, or Firm*—Frank R. Trifari; Carl P. Steinhauser

[57] ABSTRACT

The stabilization of pyrophorous iron powder in a liquid medium can be carried out in a very short time and particularly carefully when the powders are contacted with organic compounds which contain nitrogen bound to oxygen, for example, nitromethane, nitrobenzene or nitrosobenzene.

8 Claims, No Drawings

METHOD OF STABILIZING PYROPHOROUS IRON POWDER

The invention relates to a method of stabilizing pyrophorous iron powder in a liquid medium.

As a magnetic material for the manufacture of magnetic tapes, iron in powder form may also be used. The metal powder recovered in the pseudomorphous reduction from goethite has a large area (approximately 20 to 30 sq.m/g). It is pyrophorous.

In order to be able to handle the said metal powder in air, it has until now been reacted at room temperature in a nitrogen gas flow (for example in the fluid bed) with oxygen so carefully that the temperature in the powder was only 10° to 20° C above room temperature. A further method of stabilizing pyrophorous iron powder consists in that the powders are wetted with a low-boiling-point organic liquid (for example acetone, benzene, ethanol). During the slow evaporation of the organic material a reaction takes place of the iron surface with the oxygen of the air. As a result of this the metal powder is stabilized ("creeping" passivation; coating with an oxide film). Both methods take a long time and require an accurate dosing of the quantity of $N_2/O_2$ and the velocity of the evaporation of organic material, respectively.

It is the object of the invention to perform the passivation in a minimum period of time and in most careful conditions.

According to the invention this object is achieved in that the pyrophorous iron powders are contacted with organic compounds which contain oxygen bound to nitrogen.

The invention is thus based on the idea of performing the passivation, as is known, in a liquid medium but to choose as an oxygen supply an organic class of compounds which contains the oxygen bound to the nitrogen, as is the case, for example, with nitrobenzene, nitrosobenzene, azoxybenzene, dinitrobenzene, nitromethane or also with nitrocellulose.

$NO—C_6H_5$ and $C_6H_5—N=N—C_6H_5$ could be demonstrated as a reaction product in the passivation with $NO_2—C_6H_5$. In the conversion with $NO_2CH_3$ are formed inter alia gaseous reaction products, such as $N_2$ and $C_2H_6$. Since the said gaseous reaction products and also excessive $NO_2CH_3$ do not interfere at all in the further processings, nitromethane is preferred in the method according to the invention.

The ratio of a molar concentration of iron to N—O containing compound is preferably in a compound comprising a nitro group at most 20. It is even more favourable to choose $[Fe]/[NO_2—R]$ to be smaller than 20 (R is the organic radical in question). The lower limit of said ratio is determined only by the price of the $N—O_x—$ containing passivating agent ($x = 1$ or 2). In a passivation with pure $N—O_x$ containing compound such a vehement reaction may occur that a fire starts. For NO—R compounds as a passivating agent a suitable maximum ratio is 10. For molecules having several N—O containing groups corresponding suitable ratio values apply.

By the stabilization method according to the invention a considerable time-saving is obtained as compared with the conventional $N_2/O_2$ passivation (duration approximately half an hour as against 3 to 4 hours with the same quantity of iron). Furthermore it is possible that all organic solvents which are also used for the preparation of lacquer (that is for the manufacture of magnetic tape) are used as an organic medium. Excessive solvent can usually be separated very simply from the passivated iron (for example, by vacuum or filtration, decanting).

The particle size (accumulation of the primary particles) of the pyrophorous powders, however, has a certain negative influence on the duration of passivation. (slow in-diffusion of the oxidation agent into the grains). By carefully grinding said larger particles during the stabilization, however, said negative influence can be mitigated.

The static magnetic values of the iron powders thus passivated are substantially identical to the values of corresponding $N_2/O_2$ passivated powders. Nor can any difference in the corresponding IR spectra be established. The same applies to the iron content of the passivated powders. No differences were found either in the stabilization tests on the thermo balance.

The stabilization method according to the invention permits of passivating pyrophorous iron powder in an organic medium in a short period of time. When said stabilization step is carried out directly in a dispersion vessel, the moist iron powder can be further processed directly to lacquer in a subsequent step.

The invention will now be described in greater detail with reference to embodiments thereof.

EXAMPLE 1

0.72 mol (40 g) of $Fe_{active}$ were ground in 250 ml of toluene in a PVC flask with 0.063 mol (7.8 g) of nitrobenzene and approximately 50 g of steelballs ($\phi = 3$ mm) for 30 minutes. The powder and the balls were then separated from the liquid, washed several times with toluene and dried in an $N_2$ flow. The possibly occurring heat tone (temperature increase) was then established by means of a thermo element present in the powder and addition of $O_2$ to the $N_2$. Even with the $N_2/O_2$ ratio of air, no temperature increase occurs. The powder is stable in air.

EXAMPLE 2

0.36 mol (20 g) of $Fe_{active}$ were stirred in 200 ml of benzene in a polynecked flask with 0.018 mol (3.2 g) of dinitrobenzene under $N_2$ by means of a KPG stirrer. Duration 1 hour. Filtering was then carried out succeeded by several washings with benzene. The powder was dried in $N_2$ flow and tested for its stability against oxygen in the manner described in example 1. The powder is stable in air.

EXAMPLE 3

0.111 mol (6.2 g) of $Fe_{active}$ were stirred in a polynecked flask in 50 ml of benzene with 0.010 mol (1.1 g) of nitrosobenzene under $N_2$. Duration 45 minutes. The method was then continued as described in example 2 and the powder was tested for its stability in air. The powder showed a good stability.

EXAMPLE 4

0.082 mol (4.6 g) of $Fe_{active}$ were reacted while stirring in a polynecked flask with 40 ml of benzene and 0.0082 (0.5 g) of nitromethane. Duration of the test 45 minutes. The method was then continued as described in example 2. The powder is stable in air.

In the following table, static magnetic properties of powders are recorded which had been stabilized according to example 1 to 4. For comparison, the table also states values of $N_2/O_2$-treated powders. The table comprises values for $\sigma_S$, the magnetic moment per kg in a field of $10^6$ A/m (expressed in Wbm/kg), $\sigma_R$, the remanent magnetic moment per kg after magnetization in a field of $10^6$ A/m (expressed in Wbm/kg), $\sigma_S/\sigma_R$, the ratio between the two said moments, $H_c$, the magnetization coercive force (expressed in A/m), $H_R$, the remanent coercive force (expressed in A/m), and $H_c/H_r$ the ratio between the two coercive forces.

Table

Static magnetic values of stabilized iron powders

| | $\sigma_S$ | $\sigma_R$ | $\sigma_R/\sigma_S$ | $H_c$ | $H_R$ | $H_c/H_R$ |
|---|---|---|---|---|---|---|
| Example 1 | 1.86 | 0.88 | 0.47 | 8.91 | 11.10 | 0.80 |
| the same powder, $N_2/O_2$-treated | 2.06 | 0.98 | 0.48 | 9.44 | 11.47 | 0.82 |
| Example 2 | 1.87 | 0.90 | 0.48 | 9.71 | 11.92 | 0.81 |
| the same powder, $N_2/O_2$-treated | 1.80 | 0.85 | 0.47 | 9.83 | 12.10 | 0.81 |
| Example 3 | 1.98 | 0.94 | 0.47 | 9.52 | 11.80 | 0.81 |
| the same powder, $N_2/O_2$-treated | 1.80 | 0.85 | 0.47 | 9.83 | 12.10 | 0.81 |
| Example 4 | 1.93 | 0.92 | 0.48 | 9.71 | 11.98 | 0.81 |
| the same powder, $N_2/O_2$-treated | 1.80 | 0.85 | 0.47 | 9.83 | 12.10 | 0.81 |

$\sigma_S$, $\sigma_R$ in $10^{-4}$ Wbm/kg
$H_c$, $H_R$ in $10^{-4}$ A/m

What is claimed is

1. A method of stabilizing pyrophorous iron powder in a liquid medium, characterized in that the powders are contacted with organic compounds which contain oxygen bound to nitrogen.

2. A method as claimed in claim 1, characterized by the use of nitroaliphates with 1 to 10 carbon atoms in the molecule.

3. A method as claimed in claim 2, characterized by the use of nitromethane, nitroethane and/or nitropropane, 4. A method as claimed in claim 1, characterized by the use of N—O containing aromates.

5. A method as claimed in claim 4, characterized by the use of nitrobenzene, its homologues and derivitives.

6. A method as claimed in claim 4, characterized by the use of nitrosobenzene.

7. A method as claimed in claim 1, characterized in that $NO_2$-containing organic compounds are used in a ratio of molar concentration of iron to $NO_2$-containing compound smaller than 20 calculated on a nitro group.

8. A method as claimed in claim 1, characterized in that NO-containing organic compounds are used in a ratio of molar concentration of iron to NO-containing compound smaller than 10 calculated on a nitroso group.

* * * * *